United States Patent [19]

Larsen et al.

[11] 4,067,463

[45] Jan. 10, 1978

[54] APPARATUS FOR CHARGING METAL PLATES EDGEWISE INTO A METAL MELT

[75] Inventors: Stein Larsen, Grimstad, Norway; Göran Mattsmyr, Vasteras, Sweden

[73] Assignee: ASEA Aktiebolag, Vasteras, Sweden

[21] Appl. No.: 647,216

[22] Filed: Jan. 7, 1976

[30] Foreign Application Priority Data

Jan. 13, 1975 Sweden ..... 7500301

[51] Int. Cl.[2] ..... F27B 9/38

[52] U.S. Cl. ..... 214/35 R; 193/32; 432/234

[58] Field of Search ..... 214/18 R, 35 R, 18 SC, 214/21; 193/32, 40; 266/200, 900; 432/234

[56] References Cited

U.S. PATENT DOCUMENTS

| | | | |
|---|---|---|---|
| 1,883,976 | 10/1932 | Kuzell | 266/200 X |
| 2,931,478 | 4/1960 | Campbell | 193/32 X |
| 3,223,215 | 12/1965 | Budjinski et al. | 193/32 |
| 3,258,255 | 6/1966 | Tippmann | 432/234 X |
| 3,495,814 | 2/1970 | Kirkland | 214/35 R X |
| 3,672,650 | 6/1972 | Ashdown et al. | 214/18 R X |

*Primary Examiner*—Robert G. Sheridan

*Attorney, Agent, or Firm*—Kenyon & Kenyon, Reilly, Carr & Chapin

[57] ABSTRACT

An apparatus for charging a succession of metal plates edgewise and downwardly into a metal melt from a position spaced above the top level of the melt, is provided by a plate support forming a declining surface down which the plates can gravitationally fall edgewise, this surface extending from the charging position downwardly to a position adjacent to the melt level, and releasable means being provided for releasably engaging each successive plate prior to it falling from the declining surface into the melt, and for thereafter releasing the plate so that it can immerse edgewise into the melt more gently than if it fell freely down the surface, thus avoiding splashing the melt.

4 Claims, 2 Drawing Figures

APPARATUS FOR CHARGING METAL PLATES EDGEWISE INTO A METAL MELT

BACKGROUND OF THE INVENTION

This invention particularly concerns the problem involved by charging a succession of metal plates, normally one at a time, into a metal melt.

As an example of a practice involving this problem, copper cathodes which are relatively thin as compared to their length and width, are charged successively, one after another, to a copper melt contained in a melting crucible which supplies a crucible through which elongated copper products, such as wire, are continuous passed and on which the melt copper is cast, the melting crucible requiring substantially continuous charging of the copper cathodes to maintain its melt volume.

In any event, the top level of any metal melt customarily floats a reactive or protective layer; in the case of a copper melt, the layer may be coke granules floating on the melt. Therefore, it is impractical to charge metal plates one after another, by dropping the plates flatly on top of the layer floating on the melt, particularly when the plates are relative thin, because the plates may not sink through the layer until a number pile one on top of another, this resulting in uneven charging of the melt; in the case of the practice involving copper and referred to above, it is, of course, desirable to continuously and uniformly add copper to the melt as the melt is continuously and uniformly carred away from the melt by the elongated products passed through the melt.

For practical reasons, the melt and the layer floating on the melt are contained in a crucible provided with means for adding heat to the melt as required, the crucible having a roof with a charging opening. Various shapes of crucibles may be used; in the case of the previously described practice, the elongated products may be passed by a specially designed crucible which, however, must be continuously supplied through a suitable conduit by a crucible containing a heated melt and the layer, and requiring continued charging through a charging opening above the melt.

Because of the problem connected with attempts to drop the plates flatly onto the melt and its layer, attempts have been made to drop the plates edgewise, one after another, but for practical reasons, the plates must be delivered to the crucible at a substantial height above the charging opening, this resulting in the plates gravitationally acquiring a relatively high falling velocity and resulting in the melt being splashed about within the crucible. In the case of the practice referred to before, the design of the supply crucible is such that splashing of the copper melt may result in the splashed metal freezing around the charging opening and putting the equipment out of operation.

SUMMARY OF THE INVENTION

Keeping the foregoing in mind, the present invention, broadly stated, is an apparatus for charging such a succession of metal plates edgewise and downwardly into the metal melt from the position spaced above the top level of the melt, without splashing the melt about.

Such splashing is avoided by the use of a plate support forming a declining surface to the top of which the plates may be successively fed and which extends downwardly, possibly close to the vertical, and down which the plates can fall edgewise. This plate-supporting surface extends from the relatively elevated plate-feeding position downwardly to a position adjacent to the melt level and any layer floating thereon. The angularity of this surface may be such that under free-fall conditions the plates would reach the velocity which would result in the splashing which is to be avoided.

Therefore, releasable means are provided for releasably engaging each successive plate prior to it falling from the declining surface to the melt and possible layer on the melt, and for thereafter releasing the plate so it can immerse edgewise into the melt through the melt's top level more gently than if it fell freely down the surface from the elevated feeding position and without any stop at all.

To provide for an even more gentle edgewise entry of the plates, the releasable means is made so that it can engage the upper surface of each plate in a frictional manner, either to effect the halt of the plate or initially to engage the forward edge of the falling plate and thereafter effect the frictional engagement. Being frictional, the releasable means may be gradually released, or partly released, so that the plate enters the melt through any layer on the melt, at as low a velocity as is found necessary to avoid splashing of the melt to a degree causing trouble.

BRIEF DESCRIPTION OF THE DRAWINGS

A specific example of the invention is schematically illustrated by the accompanying drawings, in the form that would be used to successively charge copper cathodes into the supply crucible containing a copper melt and which supplies the working crucible, in the case of the practice previously described.

In these drawings.

DETAILED DESCRIPTION OF THE INVENTION

Figure 1:
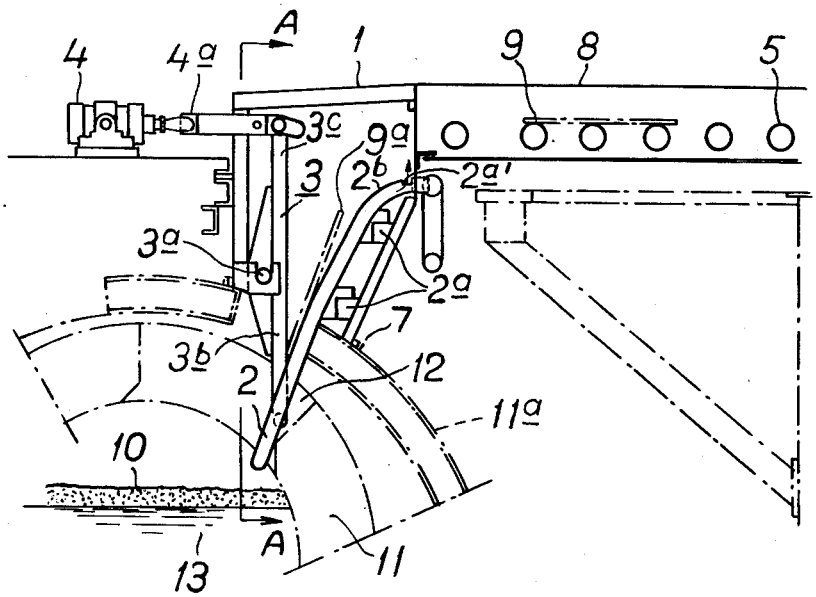
FIG. 1 shows this example in vertical section.

Having reference to the above drawings, the copper-supply crucible 11 contains the copper melt 13 on which a layer 10 of coke floats, the crucible having a charging opening 12 above the layer 10 and, although not shown, being provided with heating means for the melt. The copper cathodes 9 are fed by a powered roller bed 5 within a continuous heating furnace 8, to a position necessarily spaced a substantial distance above the charging opening 12, the copper cathodes being delivered one after another as required to maintain the volume of the melt 13; thus the described problem is involved.

The cathode, or plate, support is formed by laterally interspaced U-shaped pipe parts 2, each having their loop ends at the bottom with their legs extending upwardly substantially to the necessary elevated charging position established by the necessary end of the roller bed 5. The bottom or loop ends extend close to the upper level of the coke layer 10 and the top level of the melt 13, representing a dropping distance of very short extent. Each U-shaped pipe is supported by brickwork **2*a*, and normally be fastenings (not shown) at an angularity closely approaching the vertical, this being both to assure reliable gravitational fall of the cathodes 9 delivered from the roller bed 5 to the upper end of the plate support structure and to permit the delivery end of the roller bed to be as close as possible above the charging opening 12** of the crucible, keeping the installation as compact as possible.

The releasable means for halting free fall of the cathodes down the upper surfaces of the pipes 2, is provided by a U-shaped pipe loop 3, also having its loop end down with its legs extending upwardly and which is positioned between the two U-shaped pipes 2 so that the latter straddle this part 3. By a pivotal mounting 3*a* above the bottom ends of the pipes 2, the pipe 3 is made to form a two-arm lever having a depending arm 3*b* that swings towards and away from the upper surfaces of the pipes 2, and which is capable of swinging below these surfaces if desired. It is this depending lever arm 3*b* that is used to successively engage and release each plate falling down the top surfaces of the pipes 2. The pivot point 3*a* is laterally spaced from the upper or supporting surfaces of the pipes 2 so that the bottom end of the swinging arm 3 can engage either the forward end of each cathode, or plate, initially, and thereafter press against the cathode's top surface, or if enough force is applied to the lever arm 3*a*, it can frictionally stop a falling cathode. In any event, by frictional engagement with the top surface of a cathode and gradual release of the frictional engagement it can be assured that the cathode or plate will not only be halted momentarily and then, if desired, fully released for a short fall into the melt and layer, but also by gradual release of the frictional engagement, can be allowed to slide very gently for its immersion into the melt. Clearly, all splashing can be avoided if desired.

The U-shaped pipe 3, because of the location of its pivot point 3*a*, also forms an upstanding arm 3*c* extending upwardly, preferably to a position about level with the roller bed 5, or at least substantially above the charging opening 12 of the crucible.

A reciprocating motor 4 of the hydraulic or pneumatic thrustor type is positioned at the level of the upstanding lever arm 3*c* and connects with the latter via a suitable linkage 4*a*. This motor should be capable of pulling the lever arm 3*c* backwardly with enough force so that the lower portion of the depending lever arm 3*b* can engage the forward end of a falling cathode as indicated by broken lines at 9*a*, release then providing a relatively shorter fall for the cathode, as compared to falling from the higher position.

However, preferably the motor 4 should be capable of gradually releasing the upper lever arm 3*c* so that the cathode 9*a* can ride under the bottom end of the depending lever arm 3*b* with the latter pressing against the top surface of the cathode, further gradual release of this resulting frictional engagement permitting the cathode, or other plate, to slide gently through the layer 10, almost vertically, and into the melt 13.

The pipe parts are, of course, exposed to the heat radiation from the layer 10 and melt 13, but being pipe parts they may be internally cooled by passing a fluid coolant through them. Water cooling is undesirable because if a leak develops, the water could fall into the crucible with undesirable results. Therefore, the use of a gas coolant is indicated.

In most cases, and particularly in the case of the copper cathodes, the furnace or heating enclosure 8 contains a gaseous atmosphere for protective or treatment purposes. It is for this reason that the charging apparatus of the present invention is shown as being provided with an enclosure 1 for the discharge end of the furnace or oven 8, the enclosure being sealed around the charging opening 12, by seals 7 which connect with the outer crucible casing indicated by broken lines at 11*a*, thus providing continuous protection or treatment afforded by the gas to the cathodes.

Figure 2:
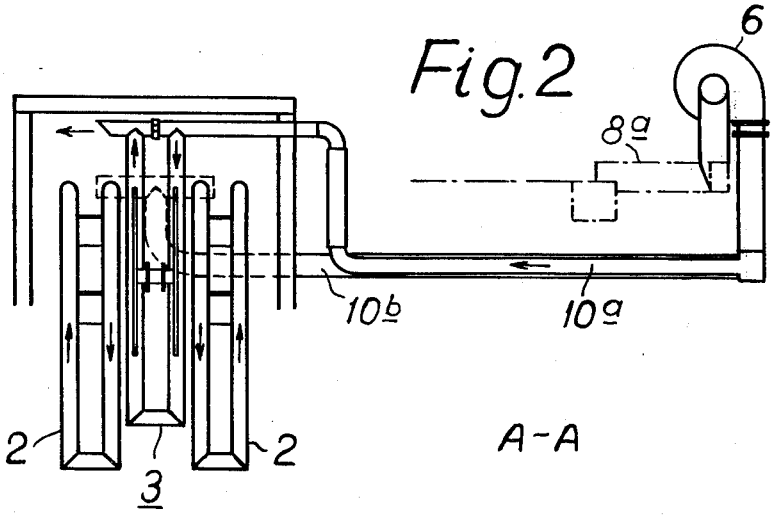
FIG. 2 shows the apparatus, largely by itself, in a front view.

With the above in mind, and as a matter of convenience, at the entrance end of the furnace or oven 8, indicated by broken lines at 8*a* in FIG. 2, the gaseous atmosphere within the furnace or oven 8, the gas atmosphere normally being continuously supplied, can in part be sucked out by a blower 6 and through a pipeline 10*a* supplied the pipe loop or lever 3, as indicated by the arrows, the atmosphere permissibly exhausting within the enclosure 1. The same blower, via a pipeline 10*b*, also supplies the two straddling pipe loops 2 forming the declining support surface, the exhaust, in this instance, being indicated at 2*a*′ in FIG. 1, and being permissibly a discharge into the enclosure 1. Because the blower 6 sucks from the front end of the furnace or oven 8, it is supplied with relatively colder gas at temperatures providing effective internal cooling for the pipe parts.

The operation of this illustrative example of the invention is as follows:

The copper 13 is continuously removed from the crucible 11 by supplying either a special crucible through which the elongated products are passed for the casting of layers on them, or for any other reason, thus requiring the melt 13 to be continuously supplied with copper cathodes. These go through the preheating or heat treatment furnace 8, being discharged from this furnace or oven 8 as a succession of cathodes by the powered roller bed 5. With the two-arm lever 3 in a position shown by FIG. 1, each discharged cathode is halted in its descent down the sharply declining supporting pipe parts 2, by the depending lever arm 3*b*. The force applied to the depending lever arm 3*b* by the motor 4 is then gradually released so that the lever arm 3*b* gradually retracts from the declining support, thus releasing the cathode so that it gently and slowly slides edgewise through the layer 10 for immersion into the melt 13, the parts then being returned to the position shown by FIG. 1. The parts exposed to the high temperatures of the crucible may be made from any of the heat-resistant metals used for furnace parts, and can be adequately cooled, as described, by coolant flows through the pipe elements. The motor 4 may be positioned well above the crucible and shielded from the heat.

Although not shown, it is possible to automate the apparatus of this invention, so that as each cathode 9 is discharged down the declining support, the depending lever arm 3*b*, which is, in effect, a jaw, is closed, then gradually reopens to drop the cathode gently into the crucible and then recloses in time to catch the next on-coming cathode as to which the same gradual jaw-opening action is repeated.

Although the pipe elements 2 could be made by moving or swinging parts, this is normally undesirable because when fixed as illustrated, the declining angularity is fixed, so that the cathodes or plates always slide at the same angularity edgewise through the layer 10 and into the melt 13. This is believed to be more desirable from the engineering viewpoint.

In addition to the above, by making the U-shaped pipe parts 2, the non-moving parts, their upper ends may be curved towards the discharge of the furnace or oven 8, these curved parts being indicated at 2*b*.

What is claimed is:

1. An apparatus for charging a succession of metal plates edgewise and downwardly into a metal melt from a position spaced above the top level of the melt, said apparatus comprising a plate support forming a declining surface down which the plate can gravitationally fall edgewise, said surface extending from said position downwardly to a position adjacent to said level, and releasable means for releasably engaging each successive plate prior to it falling from said surface into the melt, and for thereafter releasing the plate so it can immerse edgewise into the melt through its top level more gently than if it fell freely down said surface from said position, said releasable means being formed by a lever pivoted above the bottom end of said surface, so that the lever has a depending arm that swings towards and from said surface so as to successively engage and release each plate falling down said surface, said lever being a two-arm lever and having an upstanding arm extending upwardly and having swinging means for swinging the two-arm lever via said upstanding arm, said lever being formed by a U-shaped pipe having a bottom end formed by a loop and with upstanding legs forming said two-arm lever, and said support being formed by two parts straddling said lever and each formed by generally corresponding U-shaped pipes, each U-shaped pipe having means for internally flowing a coolant therethrough.

2. The apparatus of claim 1 in which said coolant is gaseous.

3. The apparatus of claim 2 in which the U-shape pipes forming said support have curved upper ends that curve towards a horizontal direction, and means are provided for feeding said plates successively to said curved upper ends to successively fall down said surface, and said swinging means is for reciprocating said upstanding arm for successive engagement and release of the successively falling plates.

4. An apparatus for charging a succession of metal plates edgewise and downwardly into a metal melt from an upper position spaced above the top level of the melt, said apparatus comprising a substantially horizontal conveyor for feeding said succession with the plates substantially horizontal and edgewise, said conveyor having a discharge end at said position and at which end said plates when discharging gravitationally tip to declining positions and fall from said end downwardly towards said melt, a plate support forming a declining surface extending substantially from said upper position to a lower position adjacent to said top level of said melt and down which surface the discharged plates can fall edgewise and into the melt, said declining surface having such an extent and angularity that under free-fall conditions the falling plates can reach a velocity resulting in undesirable splashing of said melt when the plates enter the melt's said top level, and releasable means for successively engaging each of the plates successively falling down said declining surface when arriving at a position adjacent to said lower position and at least reducing the plate's falling velocity, and in which said plate support and its said surface and said means are formed by hollow parts internally forming fluid coolant passages and in which said conveyor is enclosed within a continuous heating furnace containing an atmosphere and having entrance and exit ends and means are provided for removing a portion of said atmosphere from said furnace at a position adjacent to said entrance end and passing the removed atmosphere through said fluid coolant passages.

* * * * *